US008106367B2

(12) United States Patent
Riskin

(10) Patent No.: US 8,106,367 B2
(45) Date of Patent: Jan. 31, 2012

(54) METHOD AND IONIZER FOR BIPOLAR ION GENERATION

(75) Inventor: Yefim Z Riskin, Kazrin (IL)

(73) Assignee: Filt Air Ltd. (IL)

( * ) Notice: Subject to any disclaimer, the term of this patent is extended or adjusted under 35 U.S.C. 154(b) by 136 days.

(21) Appl. No.: 12/649,689

(22) Filed: Dec. 30, 2009

(65) Prior Publication Data

US 2011/0155923 A1 Jun. 30, 2011

(51) Int. Cl.
*H01J 27/92* (2006.01)

(52) U.S. Cl. ..... 250/424; 250/423 R; 313/306

(58) Field of Classification Search ..... 250/424
See application file for complete search history.

(56) References Cited

U.S. PATENT DOCUMENTS

| | | | | |
|---|---|---|---|---|
| 4,433,123 | A | 2/1984 | Mack | |
| 4,498,116 | A | 2/1985 | Saurenman | |
| 4,516,991 | A | 5/1985 | Kawashima | |
| 4,689,715 | A | 8/1987 | Halleck | |
| 4,734,580 | A | 3/1988 | Rodrigo et al. | |
| 4,757,422 | A | 7/1988 | Bossard et al. | |
| 5,153,811 | A | 10/1992 | Rodrigo et al. | |
| 5,532,495 | A * | 7/1996 | Bloomquist et al. | 250/492.21 |
| 5,837,035 | A | 11/1998 | Braun et al. | |
| 6,635,106 | B2 | 10/2003 | Katou et al. | |
| 6,850,403 | B1 | 2/2005 | Gefter et al. | |
| 7,254,006 | B2 * | 8/2007 | Sekoguchi et al. | 361/230 |
| 7,256,979 | B2 | 8/2007 | Sekoguchi et al. | |
| 2009/0278434 | A1 * | 11/2009 | Holland et al. | 313/306 |

FOREIGN PATENT DOCUMENTS

| | | |
|---|---|---|
| EP | 1548906 | 6/2005 |
| JP | 2006066229 | 6/2006 |
| WO | 2004102755 | 11/2004 |

* cited by examiner

*Primary Examiner* — Phillip A Johnston
(74) *Attorney, Agent, or Firm* — Niels Haan; Dann, Dorfman, Herrell & Skillman, P.C.

(57) ABSTRACT

An ionizer includes a high voltage AC generator, and a planar ion emitter mounted on an insulating substrate and having an array of planar needles that protrude from an edge of the substrate. The high voltage AC generator may be actuated by a switch having a pair of mutually insulated planar contacts located near an edge of the insulating substrate and configured to be contacted by an electrically conductive coil spring. The coil spring is supported by a slider that is moveable toward the ion emitter from an initial position wherein the planar contacts are shorted by the spring so as to actuate the high voltage AC generator. Continued movement of the spring collects dust in its coils while breaking the switch contacts and de-energizing the high voltage AC generator.

7 Claims, 2 Drawing Sheets

METHOD AND IONIZER FOR BIPOLAR ION GENERATION

FIELD OF THE INVENTION

The invention relates to methods and apparatus for bipolar ion generation, of the kind having an AC high voltage source and ion emitter such as are used for destruction of electrostatic charges in industry, as well as domestic appliances of air flow ionization.

BACKGROUND OF THE INVENTION

The main condition of efficiency of ion generators is a high ratio of the number of ions leaving the generator to the total number of ions generated by this generator. Realization of this condition largely depends on the ion emitter structure and its position in the generator.

There are such known ion emitters made of a plurality of needles, for example, those described in U.S. Pat. Nos. 4,433,123; 4,498,116; 4,689,715; 4,757,422, 5,837,035 and 6,850,403.

While the advantage of such emitters is their directed ionization from the needle tips, a significant drawback is related to the difficulty to make needles with tips of equal sharpness, which results in uneven ionization when a number of needles are used.

Ion emitters are also known in which the needles are shaped as a planar structure made from conducting material. This structure is positioned on one side of the insulating base at a considerable distance from its edge, while another planar structure used as a second electrode is positioned at the other side thereof. Such devices are described in U.S. Pat. Nos. 7,254,006 and 7,256,979 and in WO 2004/102755, JP 2004103257(A) and JP 2006066229.

A significant drawback of these emitters is the use of a large number of needles, which occupy a great deal of space. This is due to the fact that the corona discharge is generated within the insulating base between the elements of the single cells of the planar structure.

The external ion flow of each element is extremely small; hence a large number of cells is needed to achieve the required output level.

Also known are ion emitters made from a thin wire with emission occurring along the entire length thereof Such devices are described in U.S. Pat. Nos. 4,516,991 and 6,635,106.These emitters are advantageous in that the metal emitters do not cause notable change of the geometric size owing to the long and thin design of the emitter.

Nevertheless, a significant disadvantage of such emitters is that the ion emission occurs at right angles to the wire axis in all directions, which impairs the efficiency of ion generation.

Another important objective related to the ion generators is removing of dust settled on the emitter during the use. Dust settled on the emitter impairs the ion emission level because of the isolation of the ionizing (sharp) part of the emitter. In particular, when the emitter is in the form of an array of closely packed needles, dust is trapped between the needles and is difficult to remove.

There are known methods of removing of dust settled on needle emitters and apparatus thereof, for example those described in U.S. Pat. Nos. 4,734,580 and 5,153,811.

In the above-mentioned devices a cleaning device for removing dust is provided comprising brushes located between the needles and the screen. A significant disadvantage of known device is the large depth of the cleaning device, owing to which the needles must be placed at a considerable distance from the screen, which reduces the efficiency of the ion generator.

SUMMARY OF THE INVENTION

It is therefore an object of the present invention to provide an improved ion emitter that addresses at least some of the above-mentioned concerns.

To this end, the ion emitter according to the present invention is formed as a thin planar conducting structure that is mounted on an insulating substrate in such a manner that at least one edge thereof is located at the edge of the insulating substrate.

At the same time the other edges of this structure which are not located at the edge of the insulating substrate are protected with an insulating layer in order to prevent ion emission there from.

The ion emitter according to the invention has the advantages of directed (beam) emission just as in emitters made with needles and reduced size owing to the length and thinness of the wire emitters while being free of the disadvantages of known ion emitters.

According to the invention a spring is used for dust removal from the emitter. Specifically:

a. A spring is mounted on the edge of the insulation substrate in such a manner that the spring coils contact the edges of the planar conducting structure.

b. The spring travels along the conducting structure. As the spring travels it picks up by contact the accumulated dust, which is removed outside the planar structure. This solution reduces the influence of the depth of the cleaning device on the distance between the emitter and the screen of the generator body.

In one embodiment of the invention the spring is used also to switch off the generator during the emitter cleaning, for which purpose two planar electrically conductive contacts insulated from each other are mounted at the insulating substrate edge holding the emitter. The contacts serve as contacts of the generator switch.

The width of the plates and the distance between them are adjusted in such a way that in an initial state, the spring coils establish contact with the plates thereby switching the generator on.

As the spring travels towards the emitter for dust removal the connection between the plates is broken and the generator is switched off.

In this way switching on of the AC high voltage generator is prevented during cleaning or when the cleaning device (the spring) is not separated from the emitter after cleaning.

Ion generator realizing the proposed methods of ion generation and dust removal from the emitter comprises: AC high voltage generator, power supply terminals thereof, insulation substrate, planar emitter, insulating layer coating a part of the emitter, planar plates for switching on the HV generator and spring.

BRIEF DESCRIPTION OF THE DRAWINGS

In order to understand the invention and to see how it may be carried out in practice, embodiments will now be described, by way of non-limiting example only, with reference to the accompanying drawings, wherein.

DETAILED DESCRIPTION OF EMBODIMENTS

Figure 1:
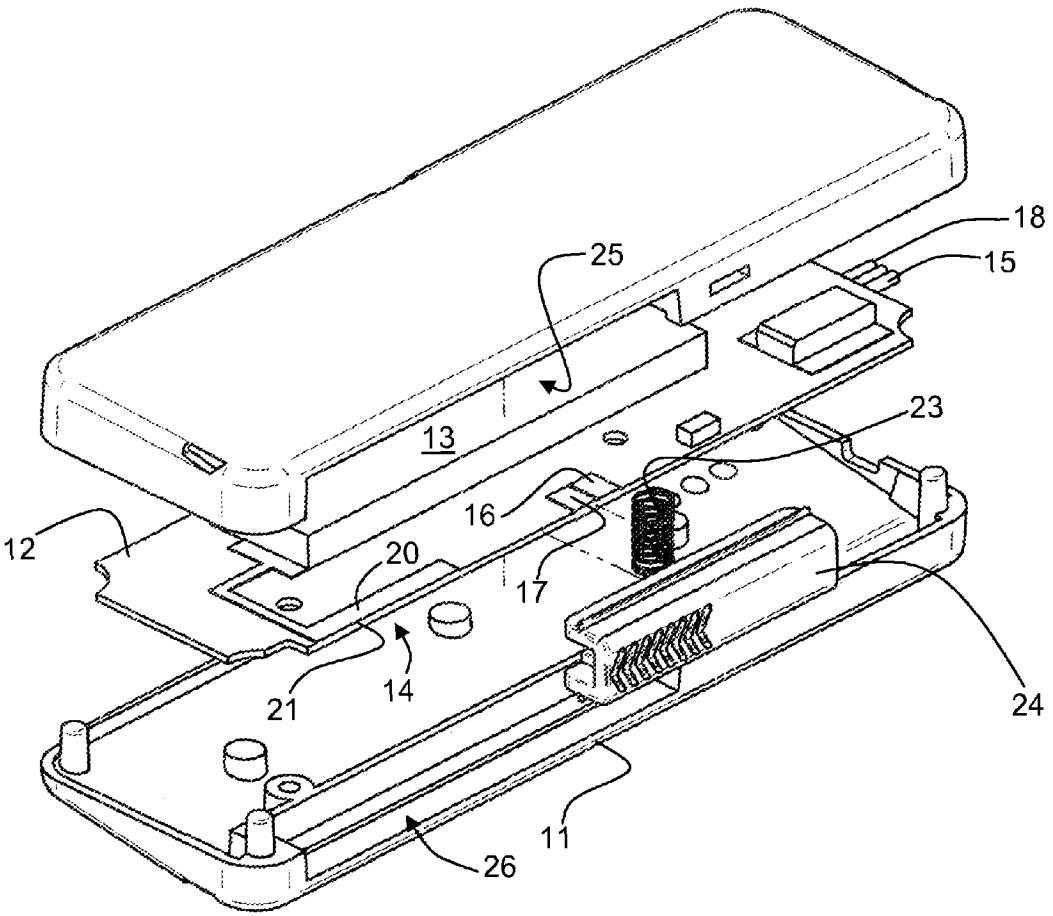
FIG. 1 is an exploded perspective view of an ionizer according to an embodiment of the invention.
Figure 2:
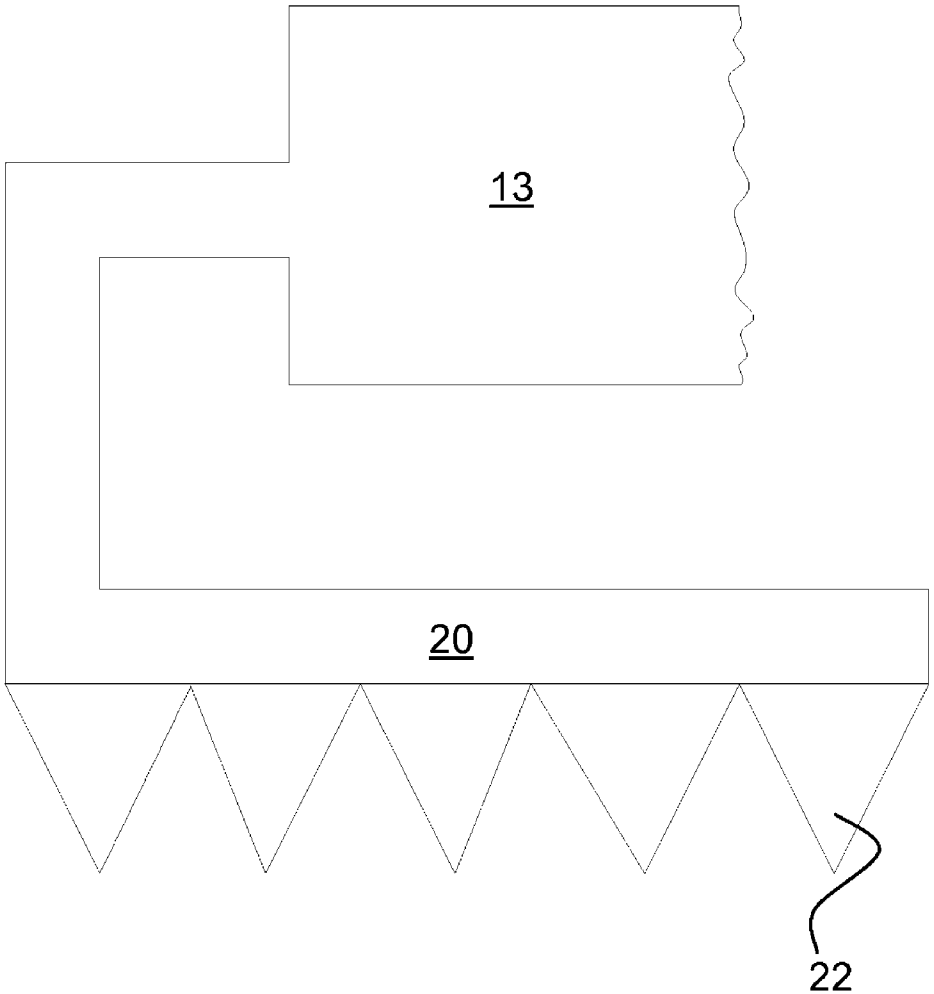
FIG. 2 is a schematic enlarged view showing a detail of an ion emitter used in the ionizer of FIG. 1.

FIG. 1 shows pictorially an ionizer shown generally as 10 according to an embodiment of the invention comprising a casing 11 in which there is mounted a substrate 12 formed of insulating material supporting an AC high voltage generator 13 an output of which is coupled to an ion emitter shown generally as 14. The AC high voltage generator 13 has a first input (not shown) coupled to a first input power supply terminal 15 and has a second input (not shown) coupled via a pair of planar switch contacts 16 and 17 to a second input power supply terminal 18 disposed on a surface of the substrate 12. The ion emitter 14 is formed as a conductive track 20 on the insulating substrate 13. As shown schematically in FIG. 2, at a front edge 21 of the insulating substrate 13, the conductive track 20 abuts an array of needles 22 that are essentially co-planar with the conductive track 20 and protrude outwardly from the front edge 21 of the insulating substrate 13 by a distance of several microns.

A coil spring 23 formed of electrically conductive material is attached or otherwise articulated to a slider 24 that is slidably supported within an edge of the casing 11. In an initial position of the slider 24, the coils of the spring 23 short the two contacts 16 and 17, thereby completing a circuit to the AC high voltage generator 13. The ion emitter 14 protrudes through a window in the casing formed between opposing recesses 25 and 26 and emits ions therethrough when the slider 24 is in the initial position. When the slider 24 is wiped across the edge of the casing 11, the coil spring 23 collects any dust within its coils while contact is broken between the coil spring 23 and the contacts 16 and 17, thereby de-activating the AC high voltage generator 13.

In use, high voltage is applied to the AC high voltage generator 13 and positive and negative ions are generated between the emitter 14 and the upper and lower edges of the casing 11 proximate the respective recesses 25 and 26, which functions as a second electrode in the corona discharge system. Because of directed ionization the most of the ions leave the casing 11 through the window formed between opposing recesses 25 and 26 and are carried by the air flow to the environment.

For dust removal from the ion emitter 14, the spring 23 held by the slider 24 is shifted from its initial state shown in FIG. 1 towards the emitter 14. Doing this achieves two objectives. First, the voltage generator 13 is initially disconnected as a result of breaking the contact between the planar contacts 16 and 17. Secondly, upon continued movement of the spring 23, the ion emitter 14 is cleaned through the removal of the accumulated dust that collects on the spring and is thus cleared away from the vicinity of the emitter.

In a specific embodiment reduced to practice, the ionizer 10 has the following parameters:

| | |
|---|---|
| 1. Emitter thickness | 50 μM |
| 2. The length of the ionizing part of the emitter | 10 mm |
| 3. Amplitude of the AC high voltage generator | ±6 kV |
| 4. Frequency of AC voltage | 100 kHz |
| 5. Level of ion output | $2 \cdot 10^9$ ion/sec |
| 6. Ozone level | 5 ppb |
| 7. Efficiency of ion generation | 90% |

The invention claimed is:

1. Method of bipolar ion generation which comprises application of AC high voltage to a planar ion emitter formed as a planar structure mounted on an insulating substrate and having an array of planar needles that protrude outward from an edge of the insulating substrate.

2. The method according to claim 1, further including removing dust by wiping a coil spring along an edge of the planar ion emitter so as to collect accumulated dust between coils of the coil spring.

3. The method according to claim 2 in which the coil spring is made from conducting material.

4. The method according to claim 3, wherein prior to wiping the coil spring along the edge of the planar ion emitter the coil spring serves to close a switch so as to actuate the ion emitter.

5. Ionizer comprising:

a high voltage AC generator, and a planar ion emitter mounted on an insulating substrate and having an array of planar needles that protrude from an edge of the substrate.

6. The ionizer according to claim 5, further comprising a coil spring which is disposed at an edge of the insulating substrate and is slidable toward the ion emitter so as to collect dust.

7. The ionizer according to claim 6, further including a switch having a pair of mutually insulated electrically conductive planar contacts located near an edge of the insulating substrate and configured to be contacted by the coil spring in an initial position of the coils spring so as to complete a circuit to the high voltage AC generator.

* * * * *